US005669196A

United States Patent [19]

Dahl

[11] Patent Number: 5,669,196

[45] Date of Patent: Sep. 23, 1997

[54] EYE BOLT REINFORCEMENT STEEL COUPLER

[76] Inventor: Kjell L. Dahl, 919 Bayside Dr., Newport Beach, Calif. 92660

[21] Appl. No.: 600,835

[22] Filed: Feb. 13, 1996

[51] Int. Cl.[6] ..... E04C 5/18

[52] U.S. Cl. ..... 52/583.1; 52/259; 52/223.7; 52/719; 52/730.2; 403/393; 403/173

[58] Field of Search ..... 52/583.1, 587.1, 52/259, 223.7, 223.13, 223.8, 719, 730.2; 403/54, 53, 67, 157, 169, 393, 395, 405.1

[56] References Cited

U.S. PATENT DOCUMENTS

| | | | |
|---|---|---|---|
| 1,388,162 | 8/1921 | Bloss et al. | 403/173 |
| 2,169,985 | 8/1939 | Hiza | 52/217 |
| 2,920,498 | 1/1960 | Federn | 403/393 X |
| 3,283,457 | 11/1966 | Hart | 52/223.7 |
| 3,292,316 | 12/1966 | Zeinetz | 52/223.7 |
| 3,394,522 | 7/1968 | Maurer | 52/583.1 |
| 3,785,095 | 1/1974 | Verner | 52/583.1 X |
| 4,251,047 | 2/1981 | Holtvogt | 52/223.13 X |
| 4,620,747 | 11/1986 | Lemmon | 403/169 X |
| 4,781,006 | 11/1988 | Haynes | 52/583.1 |

*Primary Examiner*—Carl D. Friedman
*Assistant Examiner*—Winnie Yip
*Attorney, Agent, or Firm*—Morland C. Fischer

[57] ABSTRACT

A relatively low cost, easy to install reinforcement coupler to be interconnected between a pair of opposing reinforcement steel bars that are either embedded in and protrude outwardly from adjacent precast concrete structures or form part of the reinforcement of a prefabricated reinforcement element or cast in place concrete member. An eyelet is welded to the protruding end of each reinforcement steel bar. A pair of steel coupler plates having bolt holes formed through each end thereof extends between opposite sides of the reinforcement steel bars so that the eyelets of the reinforcement steel bars are sandwiched between the coupler plates and the bolt holes at the ends of the coupler plates are axially aligned with respective ones of the eyelets. A threaded bolt is then inserted through the bolt holes in each of the ends of each of the pair of coupler plates as well as the eyelets disposed therebetween. A threaded nut is coupled to each bolt to hold the bolt in place through the bolt holes of the coupler plates and the eyelets of the reinforcement steel bars.

9 Claims, 4 Drawing Sheets

EYE BOLT REINFORCEMENT STEEL COUPLER

BACKGROUND OF THE INVENTION

1. Field of the Invention

This invention relates to a relatively low cost, easy to install reinforcement steel coupler to reliably join adjacent precast concrete members or to provide reinforcement continuity in prefabricated reinforcement elements and/or cast in place structures by means of connecting opposing reinforcement steel bars through eyelets welded on the ends thereof.

2. Background Art

It is often desirable in the construction industry to be able to reliably join two adjacent precast concrete structures or to provide reinforcement continuity in prefabricated reinforcement elements and/or cast in place concrete structures. It is equally desirable to be able to accurately determine where a reinforcement member will fail so as to protect the integrity of the total building system and to facilitate rehabilitation if necessary. In many cases, a coupler is interconnected between reinforcement steel bars that project from the adjacent structures to be joined together. However, to properly install some conventional reinforcement steel couplers, a separation of at least a foot or more is often required between the adjacent structures. In addition, the close tolerances required by threaded couplers often limits the practicality of such couplers.

Most conventional reinforcement steel couplers are known to fail prior to the failure of the reinforcement steel bars between which the coupler is interconnected. In this case, the couplers may lack the full tensile strength of standard reinforcement steel which consequently limits the application of the reinforcement steel to situations where only relatively small loads will be encountered.

Still other conventional reinforcement steel couplers are very complicated to install and/or expensive to manufacture. For example, the reinforcement steel bars between which the coupler is interconnected may be bent. The corresponding couplers tend to be large and sometimes require considerable effort in the field to achieve installation. Moreover, such couplers often demand a great deal of time and skill to assemble including significant welding and/or grouting.

What is needed is a low cost, easy to install reinforcement steel coupler that can either be made as strong as the reinforcement steel bars between which the coupler is interconnected so that the coupled connection is able to utilize the full strength of the reinforcement steel bars or can provide a predetermined point of failure under severe loading to facilitate rehabilitation and repair.

SUMMARY OF THE INVENTION

In general terms, a relatively low cost, easy to install eye bolt reinforcement steel coupler is disclosed to be interconnected between a pair of opposing reinforcement steel bars that are either embedded in and protrude outwardly from adjacent precast concrete elements or form part of the reinforcement of a prefabricated reinforcement element or cast in place concrete member to thereby enable the structures to perform well under severe loading conditions. The coupler can be manufactured to be stronger than the reinforcement steel to which it is to be interconnected so as to ensure that the full strength of the reinforcement steel is utilized.

According to the preferred embodiment of the invention, an eyelet is welded to the ends of opposing reinforcement steel bars that are either embedded in and protrude outwardly from adjacent precast concrete elements or form part of the reinforcement of a prefabricated reinforcement element or cast in place concrete member. A pair of steel coupler plates, arranged in spaced, parallel alignment, one beside the other, are connected between the opposing reinforcement steel bars at the respective eyelets thereof. More particularly, a bolt hole is formed through each end of the pair of coupler plates. The pair of coupler plates extends between opposite sides of the reinforcement steel bars so that the eyelets of the reinforcement steel bars are sandwiched between the coupler plates, and the bolt holes at the ends of the coupler plates are axially aligned with respective ones of the eyelets. A threaded bolt is then inserted through the bolt holes at each of the ends of the pair of coupler plates as well as the eyelets disposed therebetween. A threaded nut and an optional washer are coupled to each threaded bolt to hold the bolt in place through the bolt holes of the coupler plates and the eyelets of the reinforcement steel bars. As an alternate embodiment, the coupler plates can be designed to include a relatively weak region of reduced cross-section so as to function as a mechanical fuse to enable one to dictate where a structure will fail depending upon application and loading requirements.

DETAILED DESCRIPTION

Figure 1:
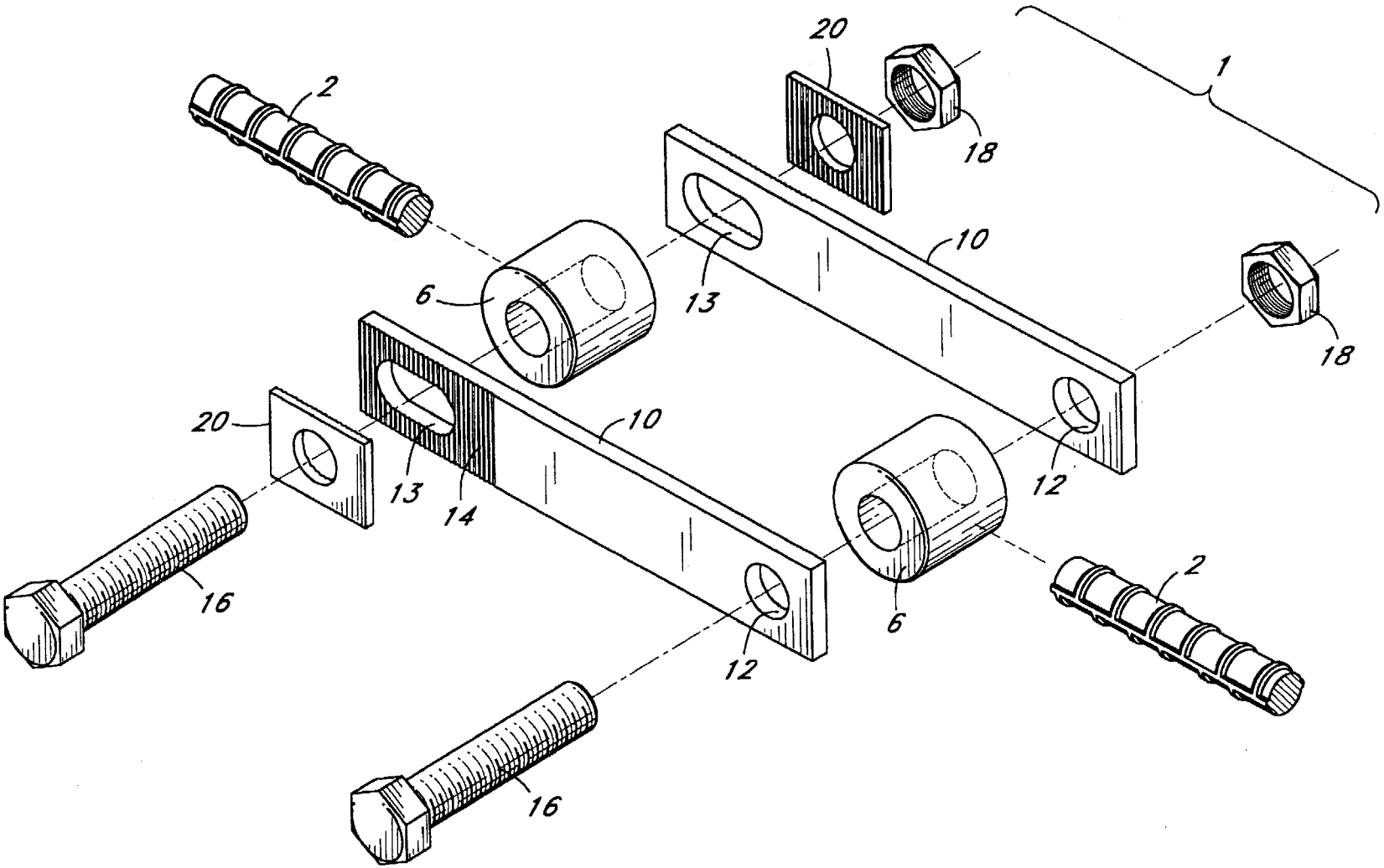
FIG. 1 shows an exploded view of the eye bolt reinforcement steel coupler which forms the preferred embodiment of the present invention.

The eye bolt reinforcement steel coupler 1 that forms the preferred embodiment of the present invention is best described while initially referring to FIGS. 1–4 of the drawings. A pair of reinforcement steel bars 2 (sometimes known as rebars) are embedded in adjacent precast concrete structures 4 to be joined together such that the reinforcement steel bars 2 protrude outwardly from the structures 4 in opposing, end-to-end alignment (best shown in FIGS. 2–4), whereby to provide continuity in the reinforcement between the structures. Such concrete structures 4 may be used in the construction industry as beams, wall panels, slabs, frames, and the like. However, it is to be understood that reinforcement steel bars 2 may also protrude from and be part of the reinforcement of a prefabricated reinforcement element or a cast in place concrete member.

In accordance with the present embodiment, an eyelet 6 is connected to the protruding end of each reinforcement steel bar 2 by means of a (e.g. friction) weld. In addition, the reinforcement steel coupler 1 includes a pair of flat steel plates or strips 10 that are to be connected between the opposing reinforcement steel bars 2 at the respective eyelets 6 thereof. The dimensions of the coupler plates 10 are not to be regarded as a limitation of the invention, and the actual size of plates 10 will depend upon the application of the reinforcement steel coupler 1, the load that coupler 1 is intended to withstand prior to failure, and the distance between the adjacent concrete structures 4. However, by virtue of the present invention, the reinforcement steel coupler 1 may be employed to join concrete structures 4 that are spaced from one another by as little as six inches.

Each of the coupler plates 10 includes one or more adjustment bolt holes 13 formed therethrough. The adjustment holes 13 may be either round or oval or have any other suitable shape. In the embodiment shown, an oval adjustment hole 13 is located at one end of the coupler plates 10 and a round bolt hole 12 is located at the opposite end. A set of serrations 14 (only one set thereof being shown) may be formed in at least the outer faces of the coupler plates 10 around the perimeter of the adjustment hole 13 therethrough. The advantage of serrations 14 will soon be described.

The aforementioned pair of coupler plates 10 are arranged in spaced parallel alignment, one beside the other. In the assembled reinforcement steel coupler configuration shown in FIGS. 2–4, the pair of coupler plates 10 extends between the eyelets 6 of the opposing reinforcement steel bars 2 that are embedded in and project outwardly from the adjacent precast concrete structures 4. More particularly, coupler plates 10 are positioned at opposite sides of the reinforcement steel bars 2 so that the eyelets 6 of the reinforcement steel bars 2 are sandwiched between the pair of coupler plates 10, and the bolt holes 12 and 13 at the opposite ends of the plates 10 are axially aligned with respective ones of the eyelets 6. A high strength threaded bolt 16 is then inserted through the bolt holes 12 and 13 of each of the pair of coupler plates 10 as well as the eyelets 6 disposed therebetween. The bolts 16 are held in place by suitably threaded nuts 18. The bolts 16 and/or nuts 18 may be interfaced with optional washers 20 that are located against the outer faces of the coupler plates 10. It may now be appreciated that the sets of serrations 14 formed in the outer faces of the coupler plates 10 and surrounding the adjustment holes 13 maximize the friction at the interface of the plate 10 with a washer 20 (and a bolt 16 or a nut 18, if no washer is used) so as to avoid an inadvertent loosening of the nuts 18 from the bolts 16 and prevent the coupler plates 10 from slipping relative to the reinforcement steel bars 2 being connected.

It is preferable that the pair of coupler plates 10 be as strong as conventional A706 reinforcement steel. However, it may also be desirable that the coupler plates 10 be weaker than the full tensile strength of the reinforcement steel bars 2 so that the plates 10 will fail before the structures 4 in which the reinforcement steel bars 2 are embedded. Therefore, in the case of a moderate earthquake, the adjacent structures 4 will be permitted to sway or drift while the reinforcement steel coupler 1 remains intact. Accordingly, the coupler plates 10 will be able to rotate slightly about the bolts 16 through the eyelets 6 at the ends of the reinforcement steel bars 2 to form a hinge and thereby absorb some of the horizontal and vertical displacements experienced by the adjacent structures 4. However, should the structures 4 be subjected to a strong earthquake, the coupler 1 will fail as a consequence of a corresponding failure of the coupler plates 10.

Figure 2:
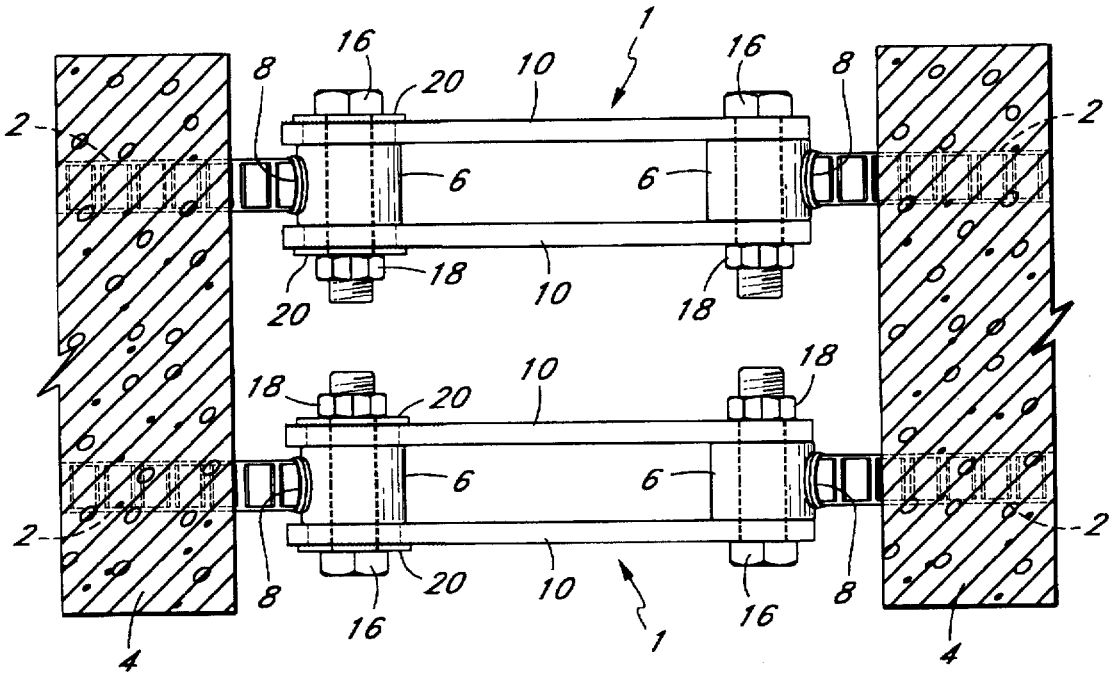
FIG. 2 is a top view showing a plurality of the reinforcement steel couplers of FIG. 1 in the assembled condition installed between the protruding ends of respective pairs of opposing reinforcement steel bars that are embedded in adjacent concrete structures.
Figure 3:
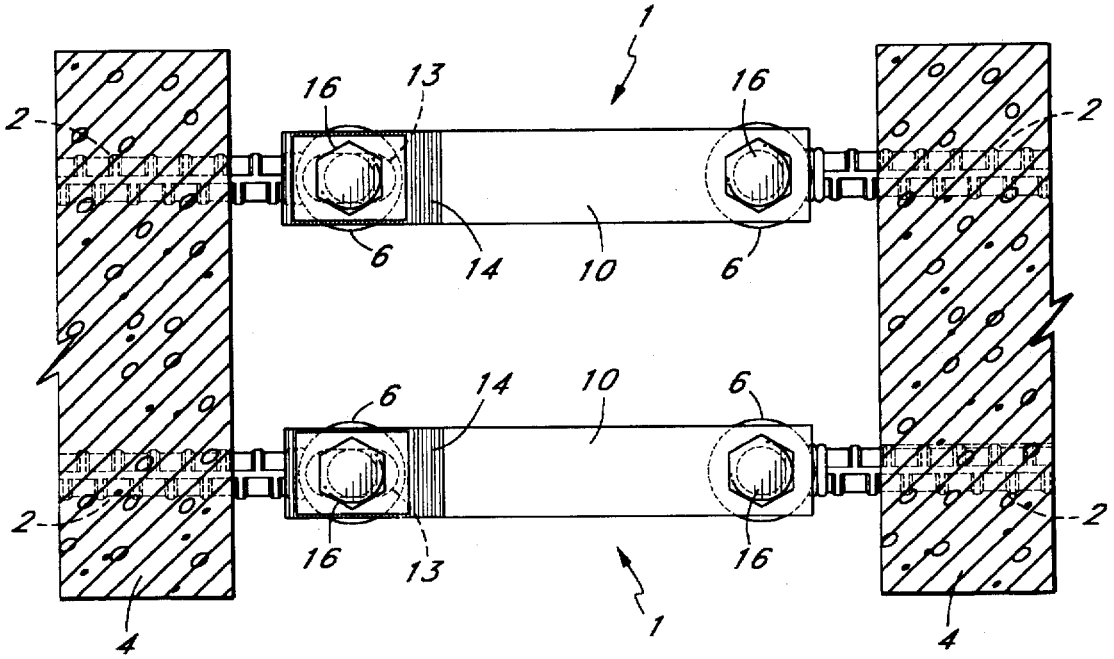
FIG. 3 is a side view showing the plurality of reinforcement steel couplets of FIG. 2 in the assembled condition.
Figure 4:
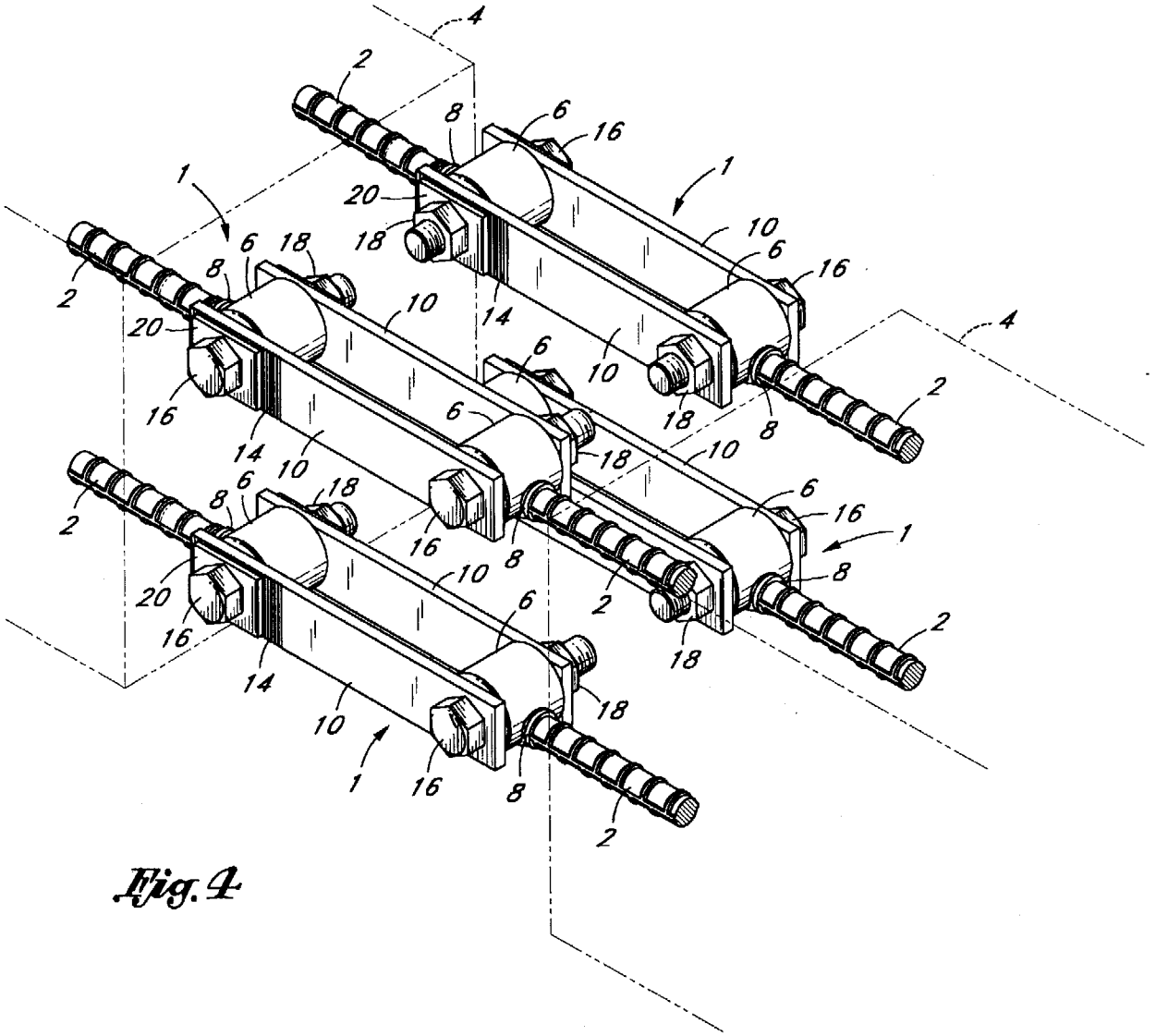
FIG. 4 is a perspective view showing the plurality of reinforcement steel couplers of FIGS. 2 and 3 in the assembled condition.

Although a single pair of reinforcement steel bars 2 have been described as being interfaced with a respective eye bolt reinforcement steel coupler 1, it is to be understood that the adjacent precast structures 4 to be joined together would usually have a plurality of reinforcement steel bars embedded therein to be interconnected by a corresponding plurality of reinforcement steel couplers 1 (in the manner shown by FIGS. 2–4). In this same regard, the versatility of the reinforcement steel coupler 1 of the present invention permits the coupler plates 10 to be interconnected between the eyelets 6 of opposing reinforcement steel bars 2 in different alignments. That is to say, and as has been described above while referring to FIGS. 1–4 of the drawings, the coupler 1 provides a relatively ductile connection between a pair of opposing reinforcement steel bars 2 embedded in adjacent precast structures 4 so that the coupler 1 is adapted to rotate relative to the reinforcement steel bars 2 in response to a corresponding movement of the structures. In this first case, a pair of coupler plates 10 are secured in spaced, parallel alignment, one beside the other, between the eyelets 6 of a single pair of reinforcement steel bars 2.

Figure 5:
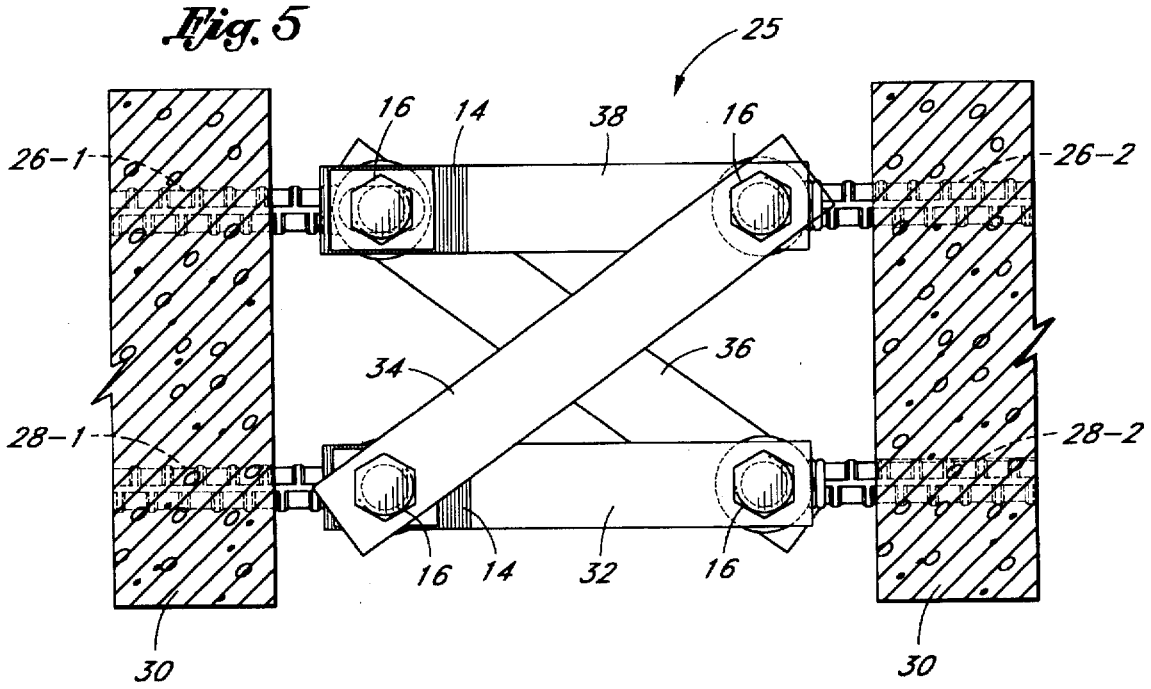
FIG. 5 is a side view of an eye bolt reinforcement steel coupler which forms an alternate embodiment of this invention installed between the protruding ends of two pairs of reinforcement steel bars that are embedded in adjacent concrete structures.

However, in FIG. 5 of the drawings, a coupler 25 is illustrated that provides a relatively stiff connection between two pairs of opposing reinforcement steel bars (26-1, 26-2 and 28-1, 28-2) that are either embedded in and protrude outwardly from adjacent precast concrete structures 30 or form part of the reinforcement of a prefabricated reinforcement element or cast in place concrete member. In this second case, a first coupler plate 32 is connected in linear alignment between the eyelets of a first pair of opposing reinforcement steel bars 28-1 and 28-2. A second coupler plate 34 is connected at one end thereof along with coupler plate 32 to the eyelet of reinforcement steel 28-1. A third coupler plate 36 is connected at one end thereof along with coupler plate 32 to the eyelet of reinforcement steel 28-2. A fourth coupler plate 38 is connected in linear alignment between the eyelets of the second pair of opposing reinforcement steel bars 26-1 and 26-2. Similarly, the opposite end of the second coupler plate 34 is then connected to the eyelet of reinforcement steel 26-2, and the opposite end of the third coupler plate 36 is connected to the eyelet of reinforcement steel 26-1. Because of the diagonally aligned coupler plates 34 and 36, the reinforcement steel coupler 25 of FIG. 5 will not rotate relative to the reinforcement steel bars 26 and 28 like the coupler 1 of FIGS. 1–4 so that coupler 25 provides a more rigid connection between the adjacent structures 30.

Figure 6:
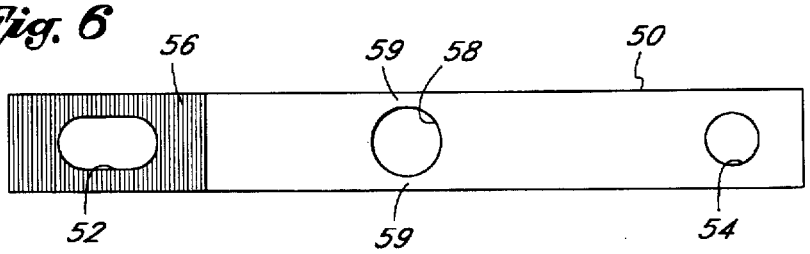
FIGS. 6 and 7 show modified coupler plates that can be used in the reinforcement steel coupler of FIG. 1.
Figure 7:
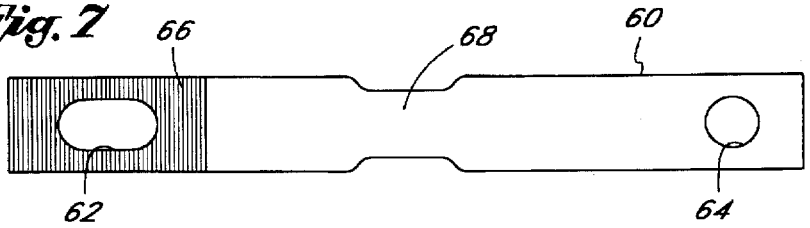

FIGS. 6 and 7 of the drawings show modifications to the coupler plates 10 for use in the reinforcement steel coupler 1 of FIG. 1. The improvements described herein introduce to each of the modified coupler plates 50 and 60 of FIGS. 6 and 7 a predetermined point of failure to facilitate rehabilitation and repair in the field. More particularly, each of the modified coupler plates 50 and 60 includes a relatively weak region of reduced area extending laterally thereacross which functions as a mechanical fuse to enable those in the construction industry to better protect the adjacent structures and people in the vicinity thereof by dictating when the coupler will fail depending upon the coupler application and the corresponding loading requirements thereof.

With regard to the coupler plate 50 of FIG. 6, an oval adjustment bolt hole 52 is located at one end and a round bolt hole 54 is located at the opposite end. The holes 52 and 54 are sized to receive threaded bolts (designated 16 in FIG. 1) therethrough. A set of serrations 56 surrounds the adjustment hole 52. Located at the mid-point of coupler plate 50 is a hole 58. By way of example, the hole 58 is round, although other shapes are contemplated, as well. The round hole 58 typically has a larger diameter than the diameter of the hole 54 so as to establish narrow areas 59 at which the coupler plate 50 is likely to fail and break when exposed to severe loading. The load required to cause coupler plate 50 to fail can be selected according to the size (i.e. diameter) of the hole 58.

With regard to the coupler plate 60 of FIG. 7, an oval adjustment bolt hole 62 is located at one end, a round bolt hole 64 is located at the opposite end, and a set of serrations 66 surrounds the adjustment hole 62. Located at the midpoint of coupler plate 60 is a narrow link 68 at which the coupler plate 60 is likely to fail and break when exposed to severe loading. The load required to cause coupler plate 60 to fail can be selected according to the size (i.e. width) of the link 68.

It will be apparent that while the preferred embodiments of this invention have been shown and described, various modifications and changes may be made without departing from the true spirit and scope of the invention.

Having thus set forth the preferred embodiments, what is claimed is:

1. A reinforcement coupler to be joined to a pair of reinforcement bars, each of said pair of reinforcement bars having one embedded end and an opposite protruding end at which an eyelet is affixed, said pair of reinforcement bars being aligned along a common axis whereby the eyelets at the protruding ends of said reinforcement bars are located opposite each other, said reinforcement coupler including first and second coupler plates, each of said first and second coupler plates having an opening formed through each end thereof, said first and second coupler plates extending between the protruding ends of said pair of axially aligned reinforcement bars in parallel alignment with one another and with said common axis so that said eyelets are sandwiched therebetween and the openings through each end of each of said first and second coupler plates are aligned with respective ones of said eyelets, and a fastener received through said openings at each end of each of said first and second coupler plates and the respective eyelet that is aligned therewith to join said coupler to said pair of reinforcement bars and permit said first and second coupler plates to rotate around said fastener relative to one of said reinforcement bars in response to a force applied to the other of said reinforcement bars.

2. The coupler recited in claim 1, wherein said fastener that is received through said openings at each end of each of said first and second coupler plates and the respective eyelet that is axially aligned therewith is a bolt.

3. The coupler recited in claim 2, wherein said bolt is threaded, said coupler also including a threaded nut to be mated to said threaded bolt to prevent said threaded bolt from being inadvertently removed from said openings through each end of said first and second coupler plates and the respective eyelet that is aligned therewith.

4. The coupler recited in claim 3, also including a set of serrations formed in said first and second coupler plates around the periphery of at least one of said openings formed therethrough to provide a friction surface against the respective bolts received through said openings.

5. A reinforcement coupler to be joined between first and second pairs of reinforcement bars, each reinforcement bar having one embedded end and an opposite protruding end at which an eyelet is affixed, the protruding ends of the first pair of reinforcement bars being arranged in spaced, opposing alignment with one another and the protruding ends of the second pair of reinforcement bars being arranged in spaced, opposing alignment with one another below the protruding ends of said first pair of reinforcement bars, said reinforcement coupler including four coupler plates, a first of said coupler plates connected between the respective eyelets at the opposing protruding ends of said first pair of reinforcement bars, a second of said coupler plates connected between the respective eyelets at the opposing protruding ends of said second pair of reinforcement bars, a third of said coupler plates connected diagonally between the eyelet at the protruding end of one reinforcement bar of said first pair of reinforcement bars and the eyelet at the protruding end of one reinforcement bar of said second pair of reinforcement bars, and the fourth coupler plate being connected diagonally between the eyelet at the protruding end of the other reinforcement bar of said first pair of reinforcement bars and the eyelet at the protruding end of the other reinforcement bar of said second pair of reinforcement bars.

6. A reinforcement coupler to be joined to a pair of reinforcement bars, each of said pair of reinforcement bars having one end affixed to a structure and an opposite free end at which an eyelet is formed, the opposite free ends of said pair of reinforcement bars being arranged in opposing alignment with one another, said reinforcement coupler including first and second coupler plates, each of said first and second coupler plates having a relatively weak portion of reduced cross sectional area extending laterally thereacross so that said coupler plates will fail at said weak region when exposed to a particular predetermined load, and each of said first and second coupler plates also having an opening formed through each end thereof, said first and second coupler plates extending in parallel alignment between the free ends of said pair of reinforcement bars so that said eyelets are sandwiched therebetween and the openings through each end of each of said first and second coupler plates are aligned with respective ones of said eyelets, and a fastener received through said openings at each end of each of said first and second coupler plates and the respective eyelet that is aligned therewith.

7. The coupler recited in claim 6, wherein said relatively weak portion of each of said first and second coupler plates is a short, narrow link located between longer and wider portions of said coupler plates.

8. The coupler recited in claim 6, wherein said relatively weak portion of each of said first and second coupler plates is established by a hole formed through said coupler plates.

9. The coupler recited in claim 6, wherein said pair of reinforcement bars are aligned along a common axis whereby the eyelets at the free ends of said reinforcement bars are located opposite each other, said first and second coupler plates extending between the free ends of said reinforcement bars in parallel alignment with one another and with said common axis.

* * * * *